United States Patent [19]

Watanabe et al.

[11] Patent Number: 4,998,038

[45] Date of Patent: Mar. 5, 1991

[54] PITTED LIGHT DIFFUSIVE COATING, A METHOD OF FORMING THE COATING AND A LAMP HAVING THE COATING

[75] Inventors: Tsutomu Watanabe; Akira Kawakatsu, both of Kanagawa; Makoto Bessho, Tokyo, all of Japan

[73] Assignee: Kabushiki Kaisha Toshiba, Kawasaki, Japan

[21] Appl. No.: 279,714

[22] Filed: Dec. 5, 1988

[51] Int. Cl.[5] ..... H01J 61/35; B05D 5/12

[52] U.S. Cl. ..... 313/116; 427/106

[58] Field of Search ..... 313/116, 112, 580, 579, 313/478, 635; 427/106, 107, 108, 110, 169, 287

[56] References Cited

U.S. PATENT DOCUMENTS

| | | | |
|---|---|---|---|
| 2,405,261 | 8/1946 | Levi et al. | 313/116 X |
| 2,922,065 | 1/1960 | Meister et al. | 313/116 |
| 3,114,668 | 12/1963 | Guiles | 313/478 X |
| 3,200,280 | 8/1965 | Thau et al. | 313/116 X |
| 3,206,632 | 9/1965 | Rokosz | 427/106 X |
| 3,919,578 | 11/1975 | Coaton et al. | 313/579 |

*Primary Examiner*—Sandra L. O'Shea
*Attorney, Agent, or Firm*—Oblon, Spivak, McClelland, Maier & Neustadt

[57] ABSTRACT

A pitted light diffusive coating having an excellent light diffusion effect and a method of forming the coating and a halogen lamp with the coating are disclosed. The light diffusive coating includes pits on the surface of a continuous coating consisting of a metal oxide formed on a base, and the coating is substantially free of bubbles. The pitted light diffusive coating is formed by coating a base with an organometallic compound and a high boiling-point organic solvent and baking the coating at about 400° C. to 500° C. The halogen lamp has a pitted light diffusive coating formed on an infrared reflective coating on the surface of the outer vessel. Strain, caused by the difference in the thermal expansion coefficient of the structural material of the outer vessel and the structural material of the light diffusive layer occurring when the outer vessel is at a high temperature, is absorbed by the pitted structure, and peeling is prevented.

6 Claims, 1 Drawing Sheet

PITTED LIGHT DIFFUSIVE COATING, A METHOD OF FORMING THE COATING AND A LAMP HAVING THE COATING

BACKGROUND OF THE INVENTION

1. Field of the Invention

The present invention relates to light diffusive coatings which are formed on the base surface of lamps such as halogen lamps and high pressure discharge lamp bulbs, and optical fibers and window glass, etc., and to methods of forming such coatings.

2. Discussion of the Background

To obtain a uniform distribution of illumination over the illuminated surface, halogen lamps for photocopiers, for example, have several filaments connected in series through conductors, and the whole assembly is enclosed in a straight tube type outer vessel made of silica glass so that it lies along the axis of the tube. However, because this halogen lamp includes a large amount of infrared radiation in its emissions, there is a danger that the item being photocopied will be damaged by the heat. For this reason, the lamp surface generally undergoes a honing treatment to provide a diffusive surface.

This method, however, has the disadvantage of being very laborious. In addition, the methods of forming a light diffusive coating by applying a fine diffusive powder such as silica to the outside of the lamp by electrostatic coating and etching may be considered. These types of coating are generally weak for mechanical stresses, wear easily, and in some cases the light diffusive effect falls off over long periods of use. Depending on the type of fine light diffusive power, there are cases in which the coating has a poor affinity for the quartz glass, and readily peels off.

With regard to these points, the inventors have previously developed the technology of forming a coating on the outer surface of the transparent outer vessel which allows visible light to pass through, but reflects infrared light, and by providing a light diffusive coating on top of the infrared reflective coating, the visible light which has passed through the infrared reflective coating is dispersed by the light diffusive coating, giving a uniform distribution of illumination on the illuminated surface. This was proposed in the Japanese Patent Application Number Sho 58-95001(95001/1983).

However, when this technology is applied to lamps, such as halogen lamps for example, because the temperature of the lamp's outer vessel is extremely high, with some light diffusive coatings there is the danger that the light diffusive coating may peel off due to the effect of repeated switching on and off over a long period of time. This means that it is essential to select a light diffusive coating which is stable regardless of the rise and fall in temperature and which is mechanically strong.

A light diffusive coating which includes bubbles and pits within a layer of metal oxide and a method for forming such a coating is disclosed in Japanese Patent Applications P59-203672 and P59-203673 and U.S. Pat. No. 4,721,877 and U.S. patent application Ser. No. 07/098,884. Although the disclosed coating provides a high diffusiveness, the presence of the bubbles decreases the light transmission and mechanical strength of the coating.

Thus, there remains a need for a light diffusive coating with improved light transmission and mechanical strength while maintaining adequate light diffusion. In addition there is a need for a method of production of such a light diffusive coating.

SUMMARY OF THE INVENTION

Accordingly, objects of the present invention include providing a light diffusive coating and a method for its manufacture which can be readily applied to large-scale production, where the coating is mechanically robust and resistant to wear, can be applied without problem to the inside or outside of the base surface of lamps, etc., regardless of their material, and which provides excellent diffusion.

Another object of the invention, moreover, does not damage the advantageous effects of the technology described in Application Number Showa 58-95001 by adding to the limits required by the light diffusive coating proposed in the application, but aims at producing a lamp in which there is no danger of the diffusive coating peeling off, even with repeated switching on and off over a long period of time.

A further object of the present invention is to provide a lamp having the light diffusive coating.

These and other objects which will become apparent from the following description of the present invention have been achieved by a light diffusive coating which comprises a metal oxide coating which has only pits and is free of bubbles.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

One embodiment of the present invention is a light diffusive coating which provides light diffusion by the inclusion of pits on the surface of a continuous coating which is formed on a base, with the coating being substantially free of bubbles (i.e. the coating possesses no more than 3% of bubbles relative to the pit density).

Another embodiment of the present invention is a method of forming the light diffusive coating having pits only formed by the vaporization of a high boiling-point organic solvent included within the metal oxide coating. This coating is formed by the application of a combination of an organometallic compound with a high boiling-point organic solvent (having a boiling point of at least 282° C.) to a base surface, and the subsequent decomposition of the organo-metallic compound on baking at a temperature of about 400° C. to about 500° C.

Another embodiment of the present invention is a halogen lamp which has a pitted light diffusive coating formed on the coating established on the surface of the outer vessel which allows visible light to pass through but reflects infra-red light, so that strain, caused by the difference in thermal expansion coefficient of the structural material of the outer vessel and the structural material of the light diffusive layer occurring when the outer vessel is at a high temperature, is absorbed by the pitted structure, and prevents peeling.

Figure 1:
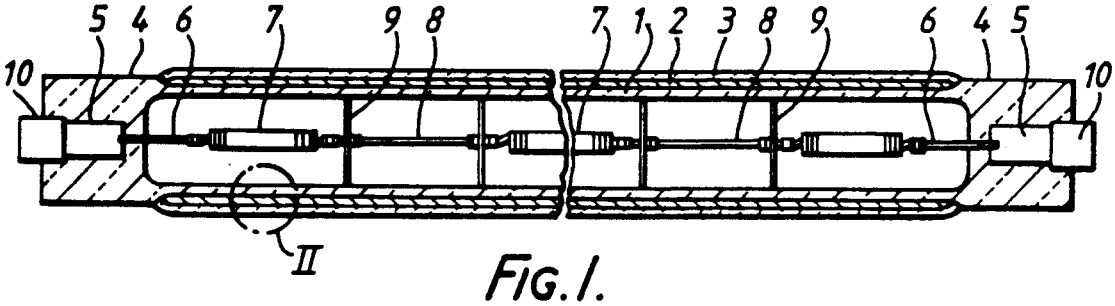
FIG. 1 shows a section of a halogen lamp which is one embodiment of the present invention.

Referring now to the drawings, wherein like reference numerals designate identical or corresponding parts throughout the several views, and more particularly to FIG. 1 thereof, there is shown a halogen lamp for a photocopier as an example of a lamp according to the third part of the present invention. This halogen lamp has had a coating 2 which allows visible light to pass through but reflects infrared light, formed on the outside surface of a straight tube type outer vessel 1 made from a transparent, heatresistant glass such as quartz glass. A pitted light diffusive coating 3 has been formed on top of the reflective coating 2. Pressure sealed seal sections 4 have been constructed at each end of the outer vessel 1, and molybdenum foil conductors 5 have been embedded into each of these seal sections 4. One end of each of these pieces of molybdenum foil 5 is in contact with internal conductors 6 which are stretched inside the outer vessel 1. Between these internal conductors 6 several filaments 7 are connected serially in position along what is virtually the center line, via non light-emitting sections formed by low resistance conductors 8. The serially connected filaments 7 and low resistance conductors 8 are held in position on the center line of the outer vessel 1 by means of anchors 9. The other ends of the foil conductors 5 are connected to the caps 10 attached to each end of the outer vessel 1 through external conductors which are not shown in the drawing. The required halogen is sealed inside the outer vessel 1 along with an inert gas such as argon.

Figure 2:
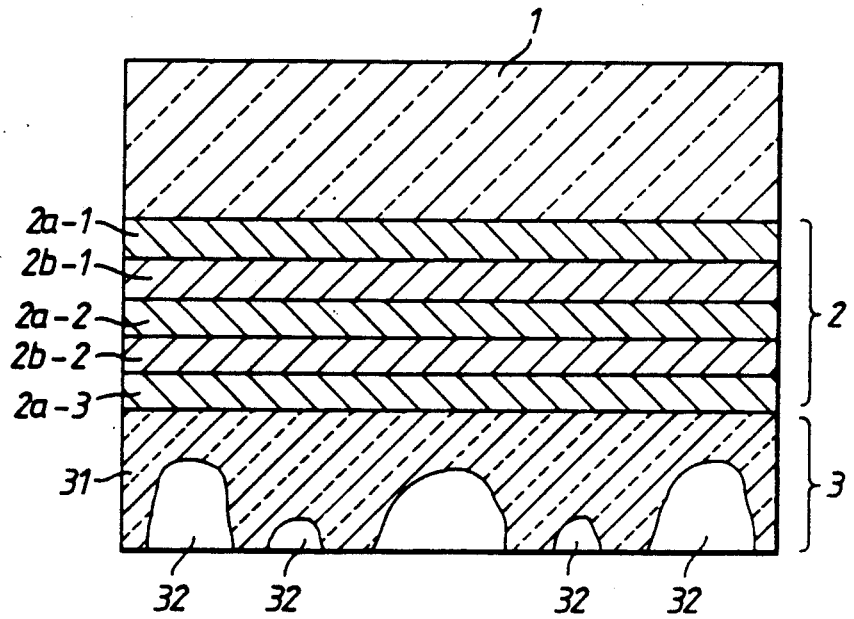
FIG. 2 shows an enlarged schematic section of section II marked on FIG. 1.

Referring now to FIG. 2, which is an enlargement of section II in FIG. 1, there is shown in detail the infrared reflecting coating 2 described above, which typically has a multilayered coating, consisting of alternate high refractive index layers 2*a* (left-slanting hatching) made from titanium oxide; $TiO_2$ etc., and low refractive index layers 2*b* (right-slanting hatching), made from silica; $SiO_2$, etc. Due to the effect of optical interference, this allows visible light to pass through readily, but reflects infrared light very well. The thicknesses of layers 2*a* and 2*b* are exaggerated in the drawing, and an appropriate thickness is 0.2–0.3 μm (micrometer).

Various types of the light diffusive coating 3 described above may be considered, but the drawings show a typical example. As is made clear by FIG. 2, the light diffusive coating 3 has numerous pits 32 on the surface of the continuous coating material 31 which is made from the metal oxide. The transmitted light is dispersed by these pits 32, and the light diffusive layer 3 appears cloudy to the naked eye. The light diffusive layer 3 is formed with a thickness of 3000–8000Å (angstrom), or 0.3–0.8 μm. Examples of suitable metal oxides are titanium oxide, $TiO_2$; silica, $SiO_2$; alumina, $Al_2O_3$; zirconia, $ZrO_2$; zinc oxide, ZnO; tantalum oxide, $Ta_2O_5$; tin oxide, $SnO_2$; and indium oxide, $In_2O_3$.

Even though the filaments 7 of the halogen lamp are arranged with spaces between them, because their light is emitted after dispersion by the light diffusive layer 3, there is no irregular illumination of the illuminated surface. Moreover, even though there is a large difference between the thermal expansion coefficients of the metal oxide which makes up the light diffusive coating 3 and the reflective coating 2 and the quartz glass forming the outer vessel 1, because the reflective coating 2 and the light diffusive coating 3 are together extremely thin, and the upper light diffusive coating 3 has pits 32 on its material 31, mechanical strain caused by the difference in the thermal expansion coefficients is alleviated, and the light diffusive coating 3 does not peel off even with repeated switching on and off over a long period of time. Furthermore, because the light diffusive coating 3 is extremely thin, the level of light loss, which is lower than 3–4%, is excellent. In addition, because the light diffusive coating 3 material is continuous, it is mechanically strong, there is no danger of wear, and there are no changes in the light diffusive characteristics over a long period of use.

The light diffusive coating having only pits displays a number of advantages over the light diffusive coating which has both bubbles and pits. The coating having only pits has a higher light transmissivity and a lower light diffusiveness, in comparison with the coating having both bubbles and pits. This is because the bubbles increase the light diffusiveness but decrease the light transmissivity. Further the coating having only pits has a higher mechanical strength, in comparison with the coating having both bubbles and pits.

The light diffusive coating having only pits is prepared by applying an organometallic compound combined with a high boiling-point solvent to a base to form a gel-state continuous coating and baking so that the organometallic compound decomposes to form a metallic oxide coating. The high boiling-point solvent forms tiny droplets which disperse through the coating. By carrying out the baking step slowly a diffusive coating containing only pits is obtained.

Fine droplets of the high boiling-point organic solvent in the gel-state continuous coating made of metal oxide such as titanium oxide concentrate together in the course of the baking process. They make a relatively large droplet when the baking process is slowly carried out.

In the baking process, the organometallic compound gradually decomposes so that the gel-state coating is gradually hardened to a hard coating.

The concentration of the droplets of the high boiling-point hydrophobic organic solvent progresses during the hardening of the coating. The droplets evaporate in the baking process so that bubbles including vapor of the high boiling point organic solvent expand.

When the expansion progresses with a strong vapor pressure before the coating is completely hardened, the vapor migrates out of the coating.

The evaporating vapor leaves a thick path in the coating when the coating is relatively soft. For example, the bubbles blow up. As a result, the bubbles become pits.

Thus, by appropriate selection of the high boiling-point organic solvent and baking temperature, the relative rates of solvent evaporation and coating hardening can be controlled such that the bubbles of high boiling-point organic surface migrate to the surface before the metallic oxide layer is completely hardened to form a diffusive layer with pits only.

Suitable high boiling-point organic solvents include dimethyl phthalate (DMP), diethyl phthalate (DEP), dibutyl phthalate (DBP), diheptyl phthalate (DHP), di-n-octyl phthalate (DnOP), diisooctyl phthalate (DIOP), di-(2-ethylhexyl) phthalate (DOP), dinonyl phthalate (DNP), diisodecyl phthalate (DIOP), ditridecyl phthalate (DTDP), diallyl phthalate (DAP), butyl benzyl phthalate (BBP), dicyclohexyl phthalate (DCHP), and di-(2-ethylhexyl) tetrahydrophthalate (DOTP). Preferred high boiling-point organic solvents are di-(2-ethylhexyl) adipate (DOA), diisodecyl adipate (DIDA), di-(2-ethylhexyl) azelate (DOZ), dibutyl sebacate (DBS), di-(2-ethylhexyl) sebacate (DOS), and di-(2-ethylhexyl) isosebacate. DOA is particularly preferred.

The temperature range for the baking step is about 400° to 500° C. Baking temperatures higher than about 500° C. result in complete hardening of the diffusive coating layer before the bubbles have migrated to the surface and give rise to light diffusive coatings which contain bubbles and pits.

Other features of the invention will become apparent in the course of the following descriptions of exemplary embodiments which are given for illustration of the invention and are not intended to be limiting thereof.

EXAMPLE

1. Preparation of the Infrared Light Reflective Coating.

To make a halogen lamp in accordance with this invention firstly, a straight tube type halogen lamp with the filaments 7 sealed inside is manufactured by normal methods. A titanium solution is then prepared by dissolving an organic titanium oxide, with tetraisopropyl titanate as the main constituent, in a low boiling-point organic solvent having a boiling point below 100° C. with acetic ester as the main constituent. This solution has 2–10% titanium by weight, and its viscosity is adjusted to approximately 1.0 cps. The sealed halogen lamp described above then has its first high refractive index layer 2a-1, consisting of titanium oxide, formed on the outer surface of the outer vessel 1 by dipping it into this titanium solution, withdrawing it at a speed of approximately 30 cm/minute, drying and baking it.

A silica solution is also prepared by dissolving an organic silicon oxide, with ethyl silicate as its main constituent, in a low boiling-point organic solvent with ethyl ester as the main constituent. This solution has 2–10% silicon by weight, and its viscosity is adjusted to approximately 1.0 cps. The halogen lamp with the first high refractive index layer 2a-1 described above then has its first low refractive index layer 2b-1, consisting of silica, formed by dipping it into this silica solution, withdrawing it at a speed of approximately 35 cm/minute, drying and baking it. Further high refractive index layers 2a-2 and low refractive index layers 2b-2 are formed alternately in the same way up to a total of about 10 layers, completing the construction of the infra-red reflective coating.

2. Preparation of the Light Diffusive Coating Having Only Pits

Figure 3:
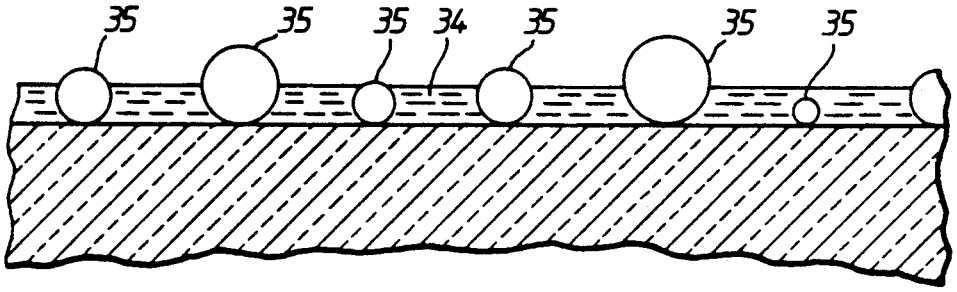
FIG. 3 shows a schematic section of the coating before baking in the method of forming the light diffusive coating.

5–10% of DOA is added to the solution of an organic titanium compound in a low boiling-point organic solvent in the example described above, and a low boiling-point organic solvent is added to the resulting solution to bring the density down to a suitable level. The halogen lamp with the infrared coating 2 described above is then dipped in this solution, withdrawn at a speed of 30–50 cm/minute and dried. DOA described above is a colorless oily liquid which boils at 214° C. at 5 mm Hg, and mutually dissolves with the low boiling-point organic solvent to a certain extent. In the drying process, only the low boiling-point organic solvent evaporates. After drying, as can be seen in FIG. 3, the gel-state coating 34 is clouded with dispersed microscopic droplets 35 of DOA.

The halogen lamp with the gel-state coating 34 is baked in air for approximately 5 minutes at approximately 400° to 500° C. When this is done, the droplets of DOA dispersed throughout the gel-state coating 34 migrate to the surface of the coating and evaporate before the coating is completely hardened to give a layer having only pits which is substantially free of bubbles. The droplets of DOA near the surface of the gel-state coating 34 burst due to their expansion, link up with the outside air and become the pits 32. Finally a light diffusive layer 3 containing only pits 32 on the surface of a continuous titanium oxide coating is formed, as shown in FIG. 2. Since DOA has a high boiling point, close to the decomposition temperature of the organic titanium compound, sufficient vapor pressure is maintained within the bubbles 32. This prevents the pits 32 from being leveled out before the decomposition and solidification of the organic titanium compound. Accordingly, the coating 34 hardens with the pits 32 still included and in good shape. If too little DOA is added, the pits 32 are too small, and the light diffusive effect is reduced. Conversely, if too much DOA is added, large irregularities in the sizes of the pits 32, local irregularities in diffusion, and large pits visible to the naked eye may be formed.

If the coating 34 is made thicker by adjusting the viscosity of the coating material, large pits are produced, but on the other hand, the pits 32 become shallower, and light dispersion deteriorates.

The light diffusion effect may be further improved by the production of 0.001–10 μm microcrystals by baking the continuous coating 31 in air at 1,000° C. for 10 minutes after the baking and hardening process described in the embodiment above. If this is done, the titanium layers in the previously formed infrared reflective coating also crystallize, but this is acceptable.

In addition, light diffusive coatings of different metal oxides may be formed by using organic compounds of other metals in the same way as in the method described above. The light diffusion effect of the light diffusive coating 3 may also be strengthened by combination with the pre-existing technology of dispersing particles of other metal compounds within the light diffusive coating material 31.

Special properties may also be produced by adding metal compound with special properties to these light diffusive coating materials. For example, by introducing powders with good thermal conductivity such as metal powders and aluminum oxide powder, the thermal radiation is increased. Also, if coloring powders such as cobalt blue are introduced, a colored light diffusive coating which emits colored light is produced. In these cases, the additive may or may not have a light diffusive effect, but if such an effect is required, the particle size of the additive should probably be 0.001 μm or larger.

The operation of the halogen lamp in the embodiment shown in FIG. 1 and FIG. 2 will now be explained. When electricity is passed between the caps 10, the filaments 7 emit light. Of the light emitted by the filaments 7 the infrared light is reflected by the infrared reflective coating 2 with most of it returning to the filaments 7 heating them, and helping to improve their light-emitting efficiency. The visible light which has passed through the infrared reflective coating 2 is dispersed by the light diffusive coating 3 and emitted as diffused light. Consequently, with this lamp, the distribution of light on the illuminated surface is more uniform, and an optical image of the filaments 7 does not arise, even if it is used in combination with a reflector.

Since there are many pits 32 in the light diffusive coating 3 of this halogen lamp, if the outer vessel 1 of the lamp is heated to a high temperature, the strains caused by the difference in the thermal expansion coefficients of the outer tube and the titanium oxide of the light diffusive coating are absorbed by the pits 32. Because of this, the light diffusive coating 3 resists peeling off, even with repeated switching on and off over a long period of time. In addition, the light diffusive coating in this embodiment is extremely thin, 0.5–1 μm, which helps to reduce the strains, and is another reason why peeling does not occur.

The present invention can also be applied to halogen lamps such as those using T-shaped tube type outer vessels or G-shaped tube type outer vessels. In a T-shaped type vessel, the filaments should be arranged almost concentrically, and in a G-shaped type vessel they should be arranged close to the center of the rounded section. In addition, this invention may be used to form layers of coatings which let through visible light but reflect infrared light and porous light diffusive coatings in the way described above on the outer surface of both blocked and unblocked transparent outer vessels. Moreover, it is possible to produce normal tube type halogen lamps with neither infrared reflective coating or light diffusive coating on the center section.

The present invention is also applicable to halogen lamps for cars by forming layers of infrared reflective coating and light diffusive coating on the outer surface of a T-shaped tube type outer glass vessel and placing a single filament in the center of this vessel.

Since, even if used in combination with a reflector, no optical image of the filament is formed on the illuminated surface, no irregular illumination is produced by the lamp.

The present invention may also be applied to ordinary lamps. The outer vessel may be either spherical or pear-shaped, and the filament should be placed at the center of the sphere or hemisphere section. In addition the present invention may be applied by forming layers of infrared reflective coating and light diffusive coating on the outer surface of an unblocked inner tube, which then has a filament placed in its center, and the assembly is then sealed in a cylindrical outer tube. In this case the inner tube touches the outer tube.

In the embodiment described above, a light diffusive coating 3 was formed on the outside surface of an outer tube, but the invention is not limited to this application. It may also be formed on any surface, such as the inside surface of a halogen lamp, on the inside or outside surfaces of ordinary lamps and infra-red lamps, etc., using soft glass such as soda lime glass or hard glass such as borosilicate glass, on the inside or outside surfaces of the outer vessel of high pressure discharge lamps, or on plate glass such as optical filters or window glass. Here, the surfaces on which the coating may be formed are given the generic name "base".

Since the light diffusive coating in the present invention produces light diffusion by means of pits on the surface of a continuous coating consisting of a metal oxide formed on a base, in spite of being extremely thin, it gives excellent light diffusion, reduces mechanical strain due to differences with the thermal expansion coefficients of the base, and can withstand repeated heating and cooling shocks over a long period, is mechanically robust, there is no reduction in light diffusion even over a long period of use, and light loss is extremely small.

The method of forming the light diffusive coating in the present invention is by applying an organo-metallic compound combined with a high boiling-point solvent to a base and baking so that the organo-metallic compound decomposes to form a metallic oxide coating. Because of this, after application, the high boiling-point organic solvent forms tiny droplets which disperse throughout the coating, and then migrate to the surface and vaporize to form pits. This method allows for the very simple formation of a light diffusive coating which is extremely thin and gives excellent light diffusion.

Since the present invention involves the establishment of a coating which allows visible light to pass through but reflects infrared light on the outside surface of the transparent outer vessel of a halogen lamp, and the establishment of a pitted light diffusive coating on top of this reflective coating, there is little infrared radiation, efficiency is high, the light distribution on the illuminated surface is uniform, and there is no danger of the appearance of an optical image of the filament, even if used in combination with a reflector. Moreover, there is the advantage that there is no danger of the coating peeling off even after repeated switching on and off over a long period, even though the outer vessel may be heated at high temperatures.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of forming a light diffusive coating, comprising the steps of:
   (i) coating an organometallic compound containing a high boiling-point organic solvent on a base; and
   (ii) forming a pitted metallic oxide coating which is substantially free of bubbles on said base by baking said organometallic compound containing said high boiling point solvent at a temperature of 400° C. to 500° C. to obtain said pitted coating.

2. The method of claim 1, wherein said high boiling-point solvent is di-(2-ethylhexly) adipate.

3. The method of claim 1, wherein said high boiling point solvent has a boiling point of at least 282° C.

4. The method of claim 1, wherein said high boiling point solvent is selected from the group consisting of dimethyl phthalate, diethyl phthalate, dibutyl phthalate, diheptyl phthalate, di-n-octyl phthalate, dionyl phthalate, di-(2-ethylhexyl) phthalate, dinonyl phthalate, diisodecyl phthalate, ditridecyl phthalate, diallyl phthalate, butyl benzyl phthalate, dicyclohexyl phthalate, di-(2-ethylhexyl) tetrahydrophthalate, di(2-ethylhexyl) adipate, diisodecyl adipate, di-(2-ethylhexyl) azelate, dibutyl secbacate, di-(2-ethylhexyl) sebacate, and di-(2-ethylhexyl) isosebacate.

5. A lamp comprising:
   a transparent glass outer vessel;
   a light diffusive pitted coating substantially free of bubbles formed on the outer surface of said outer vessel; and a filament sealed inside said outer vessel, wherein said light diffusive coating consists essentially of a metal oxide.

6. A halogen lamp comprising:

a transparent glass outer vessel;

a coating which allows visible light to pass through, but reflects infrared light, formed on the outer surface of said outer vessel;

a pitted light diffusive coating substantially free of bubbles; and a filament placed in the central section of said outer vessel, wherein said light diffusive coating consists essentially of a metal oxide.

* * * * *